United States Patent [19]

Ruchser

[11] 4,067,357

[45] Jan. 10, 1978

[54] PILOT-OPERATED DIRECTIONAL CONTROL VALVE

[75] Inventor: Erich Ruchser, Stetten, Germany

[73] Assignee: Herion-Werke KG, Fellbach, Germany

[21] Appl. No.: 585,294

[22] Filed: June 9, 1975

[30] Foreign Application Priority Data

June 14, 1974 Germany ..... 2428888
Sept. 14, 1974 Germany ..... 2443981

[51] Int. Cl.[2] ..... F15B 13/043

[52] U.S. Cl. ..... 137/596.16; 137/596.15; 137/596.18; 137/625.66

[58] Field of Search ..... 137/596.14, 596.15, 137/596.16, 596.18, 625.5, 625.66

[56] References Cited

U.S. PATENT DOCUMENTS 3,608,587 9/1971 Zbell ..... 137/625.66
3,902,526 9/1975 Brake et al. ..... 137/625.5 X

FOREIGN PATENT DOCUMENTS 1,028,841 4/1958 Germany ..... 137/625.5

*Primary Examiner*—Alan Cohan
*Assistant Examiner*—Gerald A. Michalsky
*Attorney, Agent, or Firm*—Michael J. Striker

[57] ABSTRACT

A sliding-spool direction control valve wherein the valve body has a central space for a center land which is rigid with the shank of the valve spool. The outer lands of the spool have axially extending recesses for the respective end portions of the shank. The center space is disposed between two seats and communicates with a pressure port flanked by two working ports which, in turn, are flanked by two return ports. The outer lands are disposed between the respective working and return ports and are connected with pistons which are movable in the valve body to thereby shift the spool so that the center land engages the one or the other seat. The movements of spool can be initiated by a single electromagnetic pilot valve or by two discrete pilot valves.

13 Claims, 6 Drawing Figures

PILOT-OPERATED DIRECTIONAL CONTROL VALVE

BACKGROUND OF THE INVENTION

The present invention relates to improvements in pilot-operated sliding-spool directional control valves which preferably serve to regulate the flow of a hydraulic fluid to and from a consumer, e.g., to and from double-acting actuator cylinders. More particularly, the invention relates to improvements in sliding-spool directional control valves which are preferably operated by electromagnetic pilot valve means.

It is known to provide the body of a sliding-spool directional control valve with a pressure port which is connected to a pump or another suitable source of pressurized fluid, with two working ports which are connected to a consumer, and with two return ports which are connected to a reservoir. The spool of such a directional control valve has a center piston or land which is disposed between the working ports and can seal one working port from the pressure port while the pressure port communicates with the other working port or vice versa, a first outer piston or land which seals the one working port from the associated return port when the one working port communicates with the pressure port, and a second outer piston or land which seals the other working port from the associated return port when the other working port communicates with the pressure port. All three lands are rigid with a spindle or shank of the valve spool. Therefore, the center land must invariably engage one of two centrally located seats while one of the outer lands sealingly engages an adjacent seat in the valve body, and the center land must invariably engage the other of the two centrally located seats while the other outer land sealingly engages an adjacent seat in the valve body. Such directional control valves are not reliable because the sealing action is often unsatisfactory due to manufacturing tolerances and/or as a result of wear upon the lands and/or seats.

Attempts to reduce the likelihood of leakage as a result of manufacturing tolerances and/or wear include the provision of a spool wherein one of the lands is movable lengthwise of the shank. Such directional control valves are quite complex and expensive. Moreover, the number of component parts is very high and the sealing action is still not entirely satisfactory, especially as concerns the retention of lands in sealing engagement with the respective seats.

SUMMARY OF THE INVENTION

An object of the invention is to provide a novel and improved pilot-operated directional control valve which can properly seal selected seats even if its component parts are not machined and/or assembled with a high degree of accuracy and even after extensive periods of use and resulting wear.

Another object of the invention is to provide a sliding-spool directional control valve with a novel and improved spool wherein the pistons or lands are assembled in such a way that they can invariably seal selected seats, even after long periods of use and resulting wear upon the spool and/or seats.

A further object of the invention is to provide a pilot-operated sliding-spool directional control valve which is particularly suited to regulate the flow of a hydraulic or pneumatic fluid to one or more consumers in such a way that eventual vibrations of the valve and/or fluctuations of fluid pressure cannot result in accidental leakage of fluid through those seats which are to be sealed by the respective lands.

An additional object of the invention is to provide a novel and improved sliding-spool directional control valve which can be operated by one or more electromagnetic pilot valves.

Still another object of the invention is to provide a novel and improved sliding spool and novel and improved pistons for use in a pilot-operated directional control valve of the above outlined character.

In accordance with a feature of the invention, the sliding spool of the improved directional control valve has an elongated shank or spindle which is rigid with a center land or piston and whose end portions are reciprocable in axial bores or recesses machined into two outer lands or pistons. This insures that an outer land can bear against a selected seat (e.g., between one of two working ports and one of two return ports in the valve body) while the center land seals the other working port from a pressure port and establishes communication between the pressure port and the one working port, or vice versa.

The novel features which are considered as characteristic of the invention are set forth in particular in the appended claims. The improved directional control valve itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
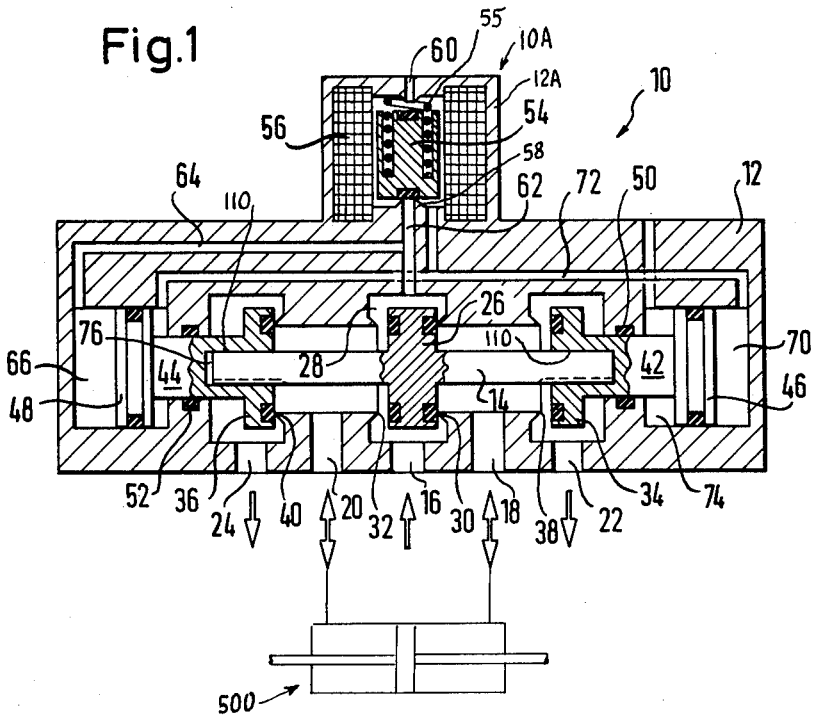
FIG. 1 is a schematic longitudinal sectional view of a pilot-operated sliding-spool directional control valve with a single electromagnetic pilot valve, the center land of the spool being shown in one end position.
Figure 2:
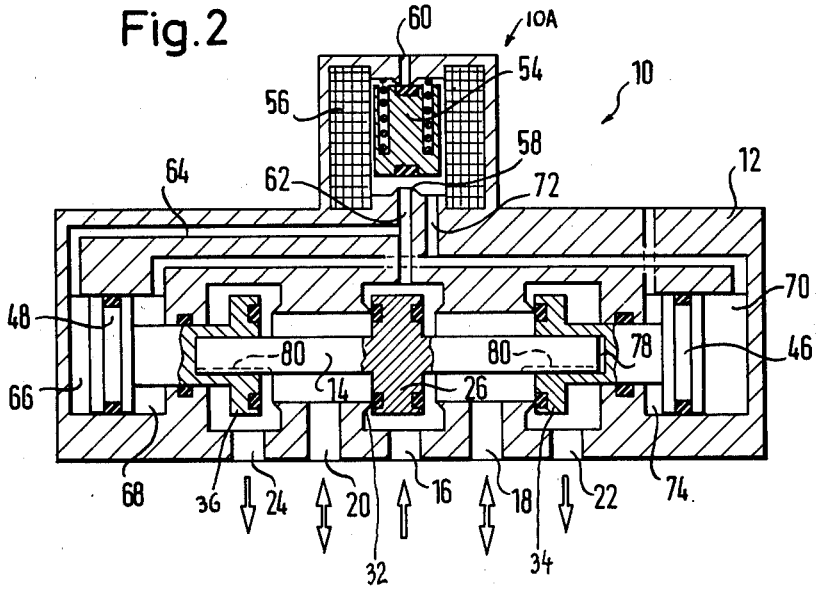
FIG. 2 is a similar view of the directional control valve, with the center land of the spool in the other end position.

FIGS. 1 and 2 show a sliding-spool directional control valve 10 which is operated by a single electromagnetic pilot valve 10A. The valve 10 includes a hollow body or housing 12 having a pressure port or inlet port 16 flanked by two working ports 18, 20 which, in turn, are flanked by two return ports or outlet ports 22, 24. The reciprocable valve member or spool in the body 12 comprises an elongated spindle or shank 14 which is rigidly connected to or integral with a center piston or land 26 and is reciprocable relative to two outer pistons or lands 34, 36. Each of the lands 26, 34, 36 has annular recesses for non-referenced sealing rings. The center land 26 is reciprocable in a center space 28 which constitutes a larger-diameter portion of a longitudinally extending bore in the valve body 12 and is in permanent communication with the pressure port 16. The valve body 12 further defines two valve seats 30, 32 which are disposed at the opposite sides of the center land 26. When the center land 26 assumes the end position shown in FIG. 1, the right-hand sealing ring of this land engages the seat 30 while the seat 32 allows pressurized fluid to flow from the port 16 into the working port 20 and thence into the left-hand chamber of a double-acting actuator cylinder 500. When the center land 26 assumes the end position shown in FIG. 2, its left-hand sealing ring engages the seat 32 and the seat 30 allows pressurized fluid to flow from the port 16 into the working port 18 and thence into the right-hand chamber of the actuator cylinder 500. The working port 18 communicates with the return port 22 when the working port 20 communicates with the pressure port 16, and the port 20 communicates with the return port 24 when the port 18 communicates with the port 16. The source of pressurized fluid (connected to the port 16) and the reservoir or tank (connected to the return ports 22, 24) are not shown in FIGS. 1 and 2. The reservoir is further assumed to be connected to a compartment 74 in the right-hand portion of the valve body 12.

The outer lands 34, 36 have axial recesses or blind bores 110 for the respective end portions of the shank 14. In FIG. 1, the sealing ring of the outer land 36 engages a seat 40 in the valve body 12 while the sealing ring of the outer land 34 is spaced apart from a further seat 38 of the valve body 12. The outer land 36 thereby seals the working port 20 (which communicates with the pressure port 16) from the return port 24; at the same time, the seat 38 allows fluid (e.g., oil) to flow from the working port 18 (which is sealed from the pressure port 16) into the return port 22. In FIG. 2, the outer land 34 seals the ports 18, 22 from each other while the outer land 36 allows the port 20 to communicate with the port 24.

The outer lands 34, 36 respectively comprise outwardly extending shafts 42, 44 which are rigid with pistons 46, 48. The piston 46 separates the aforementioned compartment 74 (which is permanently connected with the reservoir or is simply vented) from a chamber 70, and the piston 48 separates a second compartment 68 from a second chamber 66. The surface surrounding the bore in the valve body 12 has annular recesses for sealing rings 50, 52 which respectively engage the peripheral surfaces of the shafts 42, 44 so that the return ports 22, 24 are always sealed from the adjoining compartments 74, 68.

The pilot valve 10A comprises a housing or body 12A which is rigid or integral with the valve body 12 and has a return port 60 connected to the aforementioned reservoir. The body 12A receives a reciprocable valve member 54 constituting an armature having a sealing element which can engage an annular seat 58 located opposite the return port 60. The armature 54 is surrounded by a winding 56 which is installed in the body 12A and can be connected to a source of electrical energy in a well known manner, not shown in FIGS. 1 and 2. The body 12 has a channel 62 which connects the seat 58 with the central space 28 (i.e., with the pressure port 16) and which communicates with the chamber 66 by way of a channel 64. A further channel 72 connects the return port 60 of the pilot valve 10A with the chamber 70 and compartment 68. It will be noted that the chamber 66 behind the piston 48 is in permanent communication with the pressure port 16 via central space 28 and channels 62, 64.

The operation is as follows:

Pressurized fluid which is always free to flow from the port 16 into the chamber 66 urges the piston 48 and the land 36 in a direction to the right, i.e., toward engagement of the sealing ring in the land 36 with the seat 40 of the valve body 12. When the winding 56 of the pilot valve 10A is deenergized, the armature 54 seals the seat 58 under the action of a helical spring 55. This is shown in FIG. 1. Therefore, the armature 54 is remote from the return port 60 of the pilot valve 10A so that the port 60 communicates with the chamber 70 and compartment 68 via channel 72. Consequently, the pressure of fluid in the chamber 66 suffices to maintain the sealing ring of the land 36 in engagement with the seat 40, i.e., the working port 20 is sealed from the return port 24. The axial length of the recess 110 in the land 36 is such that, when the land 36 seals the ports 20, 24 from each other, the shank 14 maintains the left-hand sealing ring of the center land 26 at a substantial distance from the seat 32, i.e., the working port 20 can communicate with the pressure port 16 and the left-hand chamber of the actuator 500 receives pressurized fluid. However, the depth of the recess 110 in the land 36 is sufficient to insure that the land 36 cannot force the shank 14 to maintain the right-hand sealing ring of the center land 26 in actual engagement with the seat 30. Nevertheless, the right-hand sealing ring of the land 26 moves into engagement with the seat 30 under the action of flowing pressurized fluid. The pressure at the left-hand side of land 26 greatly exceeds the pressure at the right-hand side so that the resulting pressure differential moves the land 26 all the way to the end position of FIG. 1 in which the pressure port 16 is completely sealed from the working port 18. The just mentioned pressure differential at the opposite sides of the center land 26 causes the shank 14 (which shares all axial movements of the land 26 and vice versa) to move with respect to the land 36 (which already abuts against the seat 40) so that the innermost portion 76 of the recess 110 in the land 36 is not occupied by the shank. This portion 76 (which can be said to constitute a clearance or gap between the left-hand end face of the shank 14 and the surface bounding the inner end of the recess 110 in the land 36) communicates with the working port 20 by way of a groove 80 in the left-hand end portion of the peripheral surface of the shank 14 so that the clearance 76 is filled with pressurized fluid which assists the aforediscussed differential pressure in urging the right-hand sealing ring of the center land 26 into full engagement with the seat 30. The fluid which flows from the working port 18 into the return port 22 reduces the pressure at the right-hand side of the center land 26 below atmospheric while the left-hand side of the land 26 is acted upon by pressurized fluid filling the space 28 and flowing from the port 16 into the working port 20.

The land 34 is remote from the associated seat 38 because it is held in the position of FIG. 1 by the right-hand end portion of the shank 14 which completely fills the respective recess 110. Fluid which has filled the innermost portion of the recess 110 in the land 34 was free to escape into the return port 22 through a groove 80 machined into the peripheral surface of the right-hand end portion of the shank 14.

If the piston of the actuator 500 is to move in a direction to the left, as viewed in FIG. 1, the winding 56 of the pilot valve 10A is energized so that the armature 54 moves against the opposition of the spring 55 and seals the return port 60 from the channel 72 (see FIG. 2). At the same time, the seat 58 allows pressurized fluid to flow from the space 28 into the channel 72, i.e., the chamber 70 and a compartment 68 receive pressurized fluid. The right-hand surface of the piston 46 is larger than the right-hand or left-hand surface of the center land 26; therefore, fluid in chamber 70 causes the piston 46 to move the shaft 42, land 34 and shank 14 in a direction to the left so that the sealing ring of the land 34 engages the seat 38 and thus prevents the outflow of fluid from the right-hand chamber of the actuator 500 via ports 18 and 22. The shank 14 moves the center land 26 away from the seat 30 and close to the seat 32; at the same time, the shank 14 reduces the width of the clearance 76 to zero and causes the land 36 to move away from the seat 40. Thus, pressurized fluid flows from the port 16 into the working port 18 and into the right-hand chamber of the actuator 500 while the working port 20 communicates with the return port 24 so that fluid can flow from the left-hand chamber of the actuator 500. The center land 26 moves its left-hand sealing ring into full engagement with the seat 32 due to development of a pressure differential at the opposite sides of the land 26. The land 34 cannot participate in such final movement of the land 26 to the end position of FIG. 2 because its sealing ring already bears against the seat 38; therefore, the right-hand end of the shank 14 moves with respect to the recess 110 of the land 34 and defines therewith a clearance or gap 78 which communicates with the pressure port 16 by way of the right-hand groove 80 of FIG. 2. Fluid in the clearance 78 assists the pressure differential in maintaining the left-hand sealing ring of the center land 26 in full engagement with the seat 32.

The combined area of the right-hand surfaces of the pistons 46, 48 exceeds the combined area of the left-hand surfaces of the piston 48 and center land 26; this explains the movement of center land 26 from the end position of FIG. 1 toward the end position of FIG. 2 when the pilot valve 10A connects the channel 72 with the channel 62 via valve seat 58. The area of the left-hand surface of the piston 48 is larger than the area of the left-hand or right-hand surface of the center land 26. Also, the area of either surface of the land 26 is smaller than the area of the right-hand surface of the piston 46. The area of the left-hand surface of the land 34 equals or is smaller than the area of either surface of the center land 26; this also applies for the relationship between the surfaces of the land 26 and the right-hand surface of the land 36.

Figure 3:
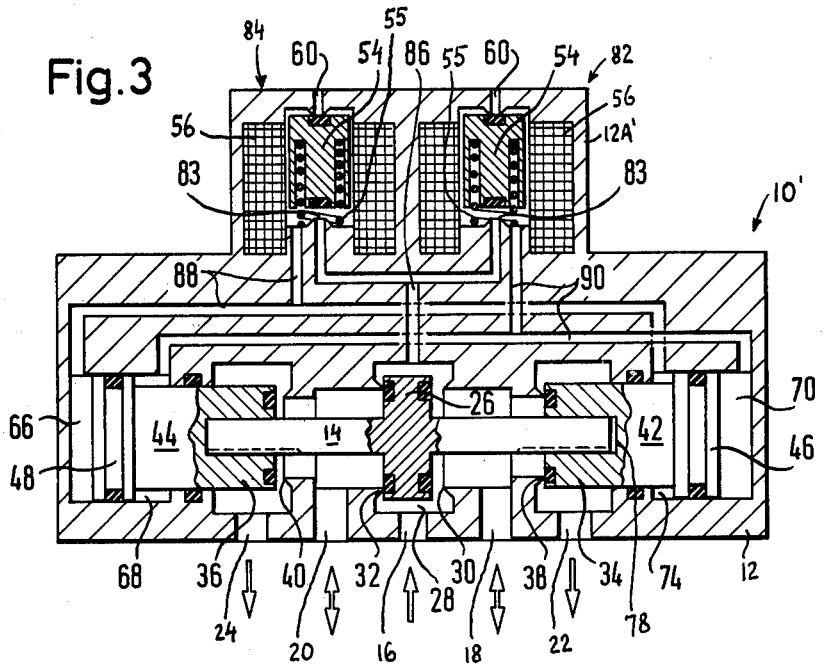
FIG. 3 is a schematic longitudinal sectional view of a second directional control valve with two electromagnetic pilot valves.

FIG. 3 shows a slightly modified sliding-spool directional control valve 10'. The main difference between the valves 10 and 10' is that the diameters of shafts 42, 44 shown in FIG. 3 equal the diameters of the respective outer lands 34, 36. All such parts of the valve 10' which are identical with or clearly analogous to the corresponding parts shown in FIGS. 1–2 are denoted by similar reference characters. The valve 10' is operated by two electromagnetic pilot valves 82, 84. The springs 55 are mounted in the common housing or body 12A' of the pilot valves 82, 84 in such a way that the respective armatures 54 normally seal the associated return ports 60. The windings of the pilot valves are shown at 56 and the seats at 83. In accordance with a feature of the structure shown in FIG. 3, momentary (i.e., short-lasting) energization of the winding 56 in one of the pilot valves 82, 84 results in a movement of the center land 26 to one end position and momentary (short-lasting) energization of the winding 56 of the other pilot valve results in a movement of the center land 26 to the other end position. The seats 83 of the pilot valves 82, 84 communicate with the space 28 in the valve body 12 by way of a channel 86. A channel 88 normally connects the seat 83 of the pilot valve 84 with the chamber 66 and compartment 74 (which is not vented), and a channel 90 normally connects the seat 83 of the pilot valve 82 with the chamber 70 and compartment 68. The windings 56 are normally deenergized, i.e., the armature 54 of the pilot valves 82, 84 normally seal the respective return ports 60 from the corresponding channels 90 and 88. Therefore, the chambers 66, 70 and the compartments 68, 74 are filled with pressurized fluid.

In the left-hand end position of the center land 26 (this end position is shown in FIG. 3), pressurized fluid acts against both sides of each of the pistons 46, 48, against the left-hand side of the land 34 (because the pressure port 16 communicates with the working port 18 and the latter is sealed from the return port 22), and against the right-hand side of the center land 26. The difference between the areas of the right-hand and left-hand sides of the piston 46 is greater than the area of the left-hand side of the land 34; therefore, the land 34 is held in engagement with the seat 38 by pressurized fluid in the chamber 70. On the other hand, the area of the right-hand side of the center land 26 is greater than the difference between the areas of the right-hand and left-hand sides of the piston 48; therefore, pressurized fluid in the chamber 66 is unable to lift the center land 26 off the seat 32. Also, the shank 14 holds the land 36 in the position of FIG. 3 in which the working port 20 communicates with the return port 24.

If the winding 56 of the pilot valve 82 is energized, the channel 86 is sealed from the channel 90 and the channel 90 communicates with the right-hand return port 60, i.e., the pressure of fluid in the chamber 70 and compartment 68 decreases. The piston 48 then moves in a direction to the right, as viewed in FIG. 3, and disengages the center land 26 from the seat 32. Such movement of the land 26 is terminated (short of complete engagement with the seat 30) when the land 36 engages the seat 40, i.e., when the working port 20 is sealed from the return port 24 but is free to communicate with the pressure port 16. The pressure of fluid acting against the left-hand side of the land 34 immediately after actuation of the pilot valve 82 (i.e., immediately after the pressure of fluid in the chamber 70 and compartment 68 collapses) causes the land 34 to move away from the seat 38. Such movement is assisted by fluid pressure in the compartment 74 so that the land 34 assumes its right-hand end position. The final stage of movement of center land 26 into sealing engagement with the seat 30 takes place due to development of a pressure differential at the opposite sides or end faces of the land 26; such pressure differential develops for the reasons explained above in connection with FIGS. 1–2. The width of the clearance 78 then decreases to zero and the shank 14 defines witth the land 36 a clearance corresponding to that shown at 76 in FIG. 1 because the land 36 cannot participate in the last stage of rightward movement of the shank 14 and land 26 since it already bears against the seat 40. The armature 54 of the pilot valve 82 can return to the position of FIG. 3 immediately or shortly after a short-lasting movement into sealing engagement with the right-hand seat 83. Thus, once the center land 26 bears against the right-hand seat 30 in the space 28, it remains in such position even if the channel 90 is again free to communicate with the pressure port 16 and is sealed from the outlet port 60 of the pilot valve 82. This is due to the fact that the area of the left-hand surface of the land 26 is greater than the difference between the areas of the right-hand and left-hand surfaces of the piston 46.

In order to return the land 26 to the end position of FIG. 3, the winding 56 of the pilot valve 84 must be energized to temporarily connect the left-hand port 60 of FIG. 3 with the chamber 66 and compartment 74 via channel 88. The piston 46 then shifts the land 34 back into sealing engagement with the seat 38 and causes the shank 14 to move the center land 26 close to the seat 32. The land 36 is moved away from the seat 40 because pressurized fluid acts against its right-hand side and because the right-hand side of the piston 48 is acted upon by pressurized fluid in the compartment 68. The final stage of movement of the center land 26 against the seat 32 is effected by pressure differential whereby the shank 14 moves relative to the land 34 and defines therewith the clearance 78. Once the land 26 has returned to the end position of FIG. 3, the winding 56 of the pilot valve 84 can be deenergized because the seat 32 remains sealed even if the chamber 66 and compartment 74 are again filled with pressurized fluid.

Figure 4:
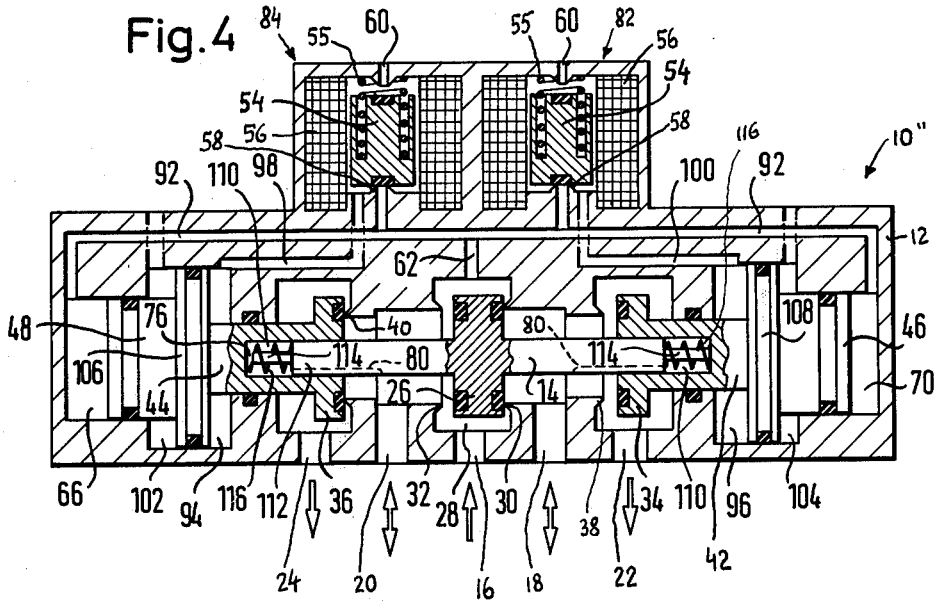
FIG. 4 is a schematic longitudinal sectional view of a third directional control valve with two electromagnetic pilot valves and with a spool having spring-biased outer lands.

FIG. 4 shows a third sliding-spool directional control valve 10'' which is operated by two pilot valves 82, 84. The pistons 46, 48 are differential pistons; they respectively comprise smaller-diameter portions inwardly adjacent to the chambers 70, 66 and larger-diameter portions 108, 106 disposed between compartments 96, 104 and 94, 102, respectively. The outer compartments 104, 102 are vented and the inner compartments 96, 94 normally communicate with the return ports 60 of the pilot valves 82, 84 by way of channels 100, 98 machined into the valve body 12. The chambers 66, 70 are connected to each other, to the space 28 and to the seats 58 of the pilot valves 82, 84 by channels 62, 92. The springs 55 of the pilot valves 82, 84 normally urge the respective armatures 54 against the associated seats 58 so that the channel 92 is normally sealed from the return ports 60. The end portions 112 of the shank 14 of the spool in the valve body 12 have smaller-diameter stubs or extensions 114 which are surrounded by helical springs 116 serving to bias the outer lands 34, 36 away from the center land 26.

In FIG. 4, the pilot valves 82, 84 are closed, i.e., their armatures 54 sealingly engage the respective seats 58, and the right-hand sealing ring of the center land 26 engages the seat 30. Thus, the right-hand working port 18 communicates with the return port 22 but is sealed from the pressure port 16, and the left-hand working port 20 communicates with the pressure port 16 while being sealed from the return port 24 because the sealing ring of the outer land 36 engages the seat 40. The compartments 94, 96 communicate with the return ports 60 of the pilot valves 84, 82 by way of the channels 98, 100. The chambers 66, 70 are filled with pressurized fluid because they communicate at all times with the pressure port 16 via space 28 and channels 62, 92. The center land 26 is urged away from the seat 30 by pressurized fluid acting against the right-hand side of the piston 46 in chamber 70. The area of the piston 46 in chamber 70 is greater than the area of the right-hand or left-hand side of the land 26. At the same time, the land 26 is urged against the seat 30 by pressurized fluid which fills the clearance 76 communicating with the pressure port 16 via groove 80 in the left-hand end portion 112 of the shank 14. Pressurized fluid also acts against the left-hand side of the land 26. Still further, the land 26 is indirectly urged against the seat 30 by pressurized fluid in the chamber 66 because such fluid maintains the sealing ring of the outer land 36 in engagement with the seat 40 and thereby stresses the spring 116 in the left-hand recess 110. Pressurized fluid tends to move the land 36 away from the seat 40 by acting against the left-hand side of this land and also against the surface at the bottom of the left-hand recess 110. The bias of spring 116 and the pressure of fluid in chamber 66 plus the pressure of fluid against the left-hand side of the center land 26 suffice to maintain the land 26 in the end position shown in FIG. 4.

If the center land 26 is to move to the left-hand end position of sealing engagement with the seat 32, the winding 56 of the pilot valve 84 is energized for a short interval of time. The left-hand armature 54 is then moved against the opposition of the respective spring 55 and seals the left-hand return port 60 from the channel 98 and compartment 94. Thus, the compartment 94 receives pressurized fluid from port 16 via space 28, channel 62, channel 92, left-hand seat 58 and channel 98. The pressure of fluid in compartment 94 effects a movement of the larger-diameter portion 106 of piston 48 and shaft 44 in a direction away from the land 34 whereby the pressurized fluid acting against the left-hand side of the land 36 moves the latter away from the seat 40 so that the left-hand working port 20 begins to communicate with the return port 24. The pressure acting against the left-hand side of the center land 26 decreases because the working port 20 communicates with the return port 24, and the piston 46, which is acted upon by pressurized fluid in chamber 70, can thus shift the land 34, shaft 42 and shank 14 in a direction to the left so that the sealing ring of the land 34 engages the seat 38 and the left-hand sealing ring of the center land 26 moves into immediate proximity of the seat 32. The working port 18 then communicates with the pressure port 16 but is sealed from the return port 22. The leftward movement of piston 46 is terminated before the center land 26 engages the seat 32 because the land 34 reaches the seat 38 before the left-hand sealing ring of the land 26 engages the seat 32. The pressure differential which develops at the opposite sides of the center land 26 then effects the final stage of leftward movement of land 26 into engagement with the seat 32 which thereby completely seals the pressure port 16 from the left-hand working port 20. The energization of left-hand winding 56 can be completed as soon as the center land 26 reaches its left-hand end position. The land 26 then remains in such position because the right-hand groove 80 of FIG. 4 admits pressurized fluid into the right-hand recess 110; such fluid bears against the right-hand end faces of the right-hand end portion 112 and right-hand stub 114. The right-hand spring 116 also contributes to retention of the center land 26 in the left-hand end position.

If the center land 26 is to be returned to the right-hand end position of FIG. 4, the right-hand winding 56 is energized to seal the port 60 of the pilot valve 82 from the channel 100 and to connect the compartment 96 with the pressure port 16 via space 28, channel 62, channel 92, right-hand seat 58 and channel 100. The portion 108 of the differential piston 46 then moves the land 34 away from the seat 38 and the piston 48 moves the land 36 and shank 14 in a direction to the right to thereby move the center land 26 into immediate proximity of the seat 30. The last stage of movement of center land 26 to the end position of FIG. 4 is effected by pressurized fluid which establishes a pressure differential at the opposite sides of the land 26.

The overall length of the shank 14 (inclusive of the two stubs 114) is selected in such a way that the left-hand stub 114 does not touch the surface in the deepest portion of the left-hand recess 110 (see the clearance 76 shown in FIG. 4) when the center land 26 is held in the right-hand end position, and that the right-hand stub 114 does not engage the surface at the inner end of the right-hand recess 110 when the center land 26 is held in the left-hand end position. The right-hand stub 114 then defines with the outer land 34 a clearance corresponding to the clearance 78 shown in FIG. 3. The axial length of each spring 116 (in unstressed condition thereof) is greater than the length of a stub 114; this enables these springs to furnish the force which is needed to maintain the center land 26 in the one or the other end position.

Figure 5:
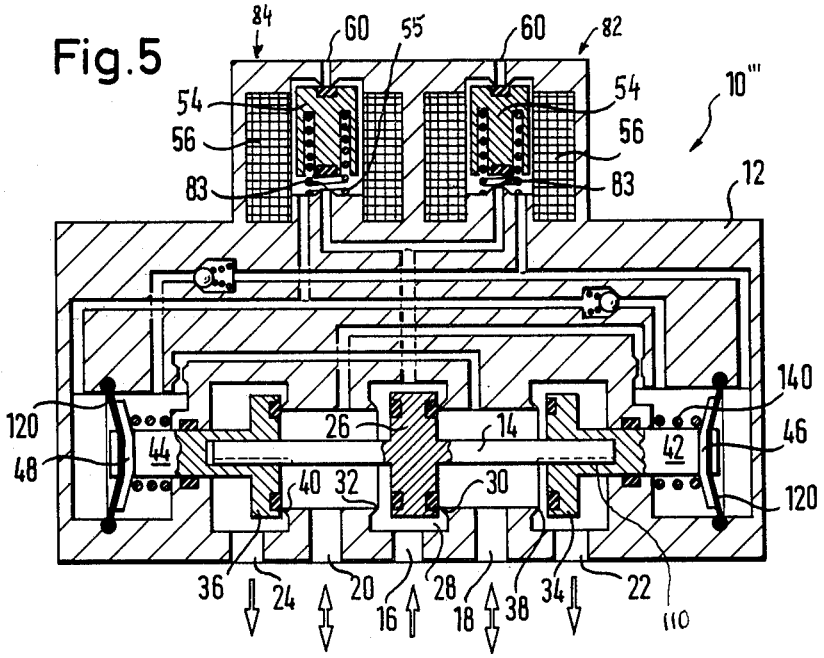
FIG. 5 is a schematic longitudinal sectional view of a fourth directional control valve with two electromagnetic pilot valves and with membrane-like pistons connected to the outer lands of the spool.
Figure 6:
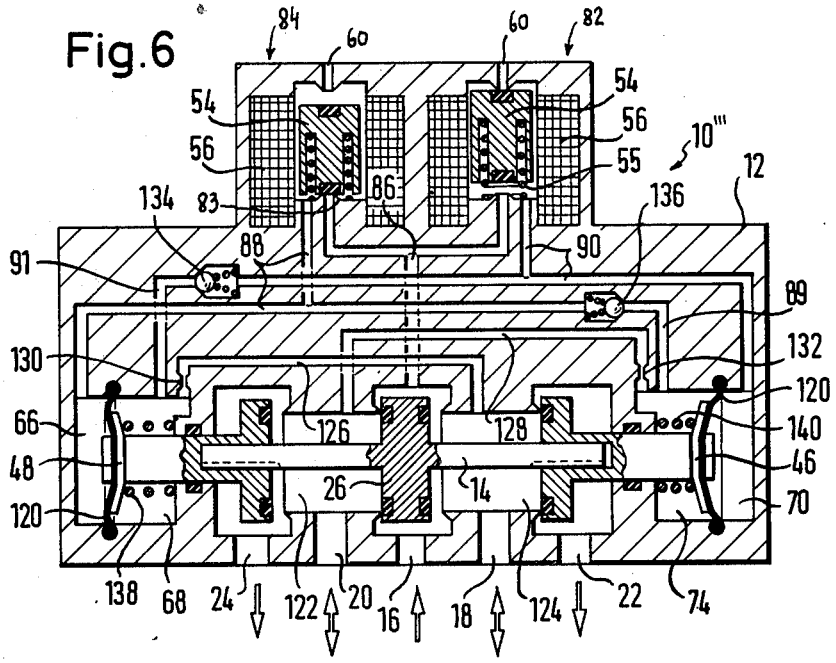
FIG. 6 shows the valve of FIG. 5 with the center land of the spool in a different position.

FIGS. 5 and 6 show a fourth sliding-spool directional control valve 10''' with two electromagnetic pilot valves 82, 84. The valve 10''' exhibits the advantage that the center land 26 of the spool in the valve body 12 can be held or "locked" in each end position against accidental or unintentional movement from such position. The holding or locking action is effected by pressurized fluid which insures that the center land 26 cannot vibrate in either end position and thus prevents leakage of pressurized fluid from the pressure port 16 into the working port 18 when the working port 20 receives pressurized fluid, or vice versa.

The seats of the pilot valves 82, 84 are shown at 83, the armatures at 54, the springs at 55 and the windings at 56. The springs 55 normally urge the respective armatures 54 away from the associated seats 83, i.e., into sealing engagement with the return ports 60. The seats 83 are connected with the space 28 (and hence with the pressure port 16) by a channel 86. The chamber 66 in the valve body 12 is connected with the compartment 74 (which is not vented) by a channel 88 containing a check valve 136 normally sealing the end portion 89 of the channel 88 from the chamber 66. The channel 88 normally communicates with the pressure port 16 via central space 28, channel 86 and left-hand seat 83. The chamber 70 normally communicates with the pressure port 16 via central space 28, channel 86, right-hand seat 83 and a channel 90. The latter contains a check valve 134 which normally seals the chamber 70 from the compartment 68 and the left-hand end portion 91 of the channel 90. The compartment 68 communicates with an additional space 124 between the lands 26, 34 by a channel 126 in the valve body 12. The latter is further formed with a channel 128 which connects the compartment 74 with another additional space 122 between the lands 26, 36 and contains a flow restrictor 132. A flow restrictor 130 is also provided in the channel 126. The additional space 122 communicates at all times with the working port 20, and the additional space 124 communicates at all times with the working port 18.

The operation of the valve 10''' is as follows:

In FIG. 5, the pilot valves 82 and 84 are closed, i.e., the return ports 60 are sealed by the respective armatures 54 and the seats 83 of the valves 82, 84 respectively communicate with the channels 90 and 88. The pressure of fluid in chambers 66, 70 matches the fluid pressure in the port 16. The right-hand sealing ring of the center land 26 engages the seat 30, the sealing ring of the outer land 36 bears against the seat 40, and the outer land 34 allows fluid to flow from the working port 18 into the return port 22. Thus, the space 124 is free to communicate with the reservoir. The pressure of fluid in the compartment 68 is low because this compartment communicates with the space 124 via channel 126. The space 122 is filled with pressurized fluid which flows from the pressure port 16 into the working port 20 (the latter is sealed from the return port 24). The pressure of fluid in the compartment 74 matches the pressure of fluid in the port 16 because the compartment 74 communicates with the space 122 via channel 128. The relationship between various forces acting upon the pistons 46, 48 and lands 26, 34, 36 is as follows:

The pressure of fluid in the chambers 66, 70 matches the pressure of fluid in the port 16. Since the pressure of fluid in the compartment 74 also matches the pressure at the port 16, fluid pressures at the opposite sides of the piston 46 would neutralize each other save for the fact that the effective area of the left-hand side of the piston 46 is smaller than the effective area of the right-hand side (see the shaft 42). The difference between the pressures acting against the opposite sides of the piston 46 is taken up by a helical compensating spring 140 mounted in the compartment 74 to react against the body 12 and to urge the piston 46 in a direction to the right, as viewed in FIG. 5 or 6. The bias of the spring 140 equals or approximates the cross-sectional area of the shaft 42 multiplied by the fluid pressure in the compartment 74. The spring 140 surrounds the shaft 42 in the compartment 74. Owing to the provision of this spring, the piston 46 does not tend to shift the lands 34 and 26 of the spool in the body 12. The center land 26 is urged against the seat 30 by fluid pressure in the space 122. The pressure of fluid in the space 124 is much lower because the working port 18 communicates with the return port 22; as a rule, the pressure in space 124 equals or closely approximates atmospheric pressure. The land 36 is biased in a direction away from the seat 40 by pressurized fluid in the space 122; however, the piston 48 is subjected to full fluid pressure in the chamber 66. The effective area of the left-hand side of the piston 48 is greater than the effective area of the right-hand side of the land 36; therefore, the land 36 is held in sealing engagement with the seat 40. The bias of the compensating spring 138 in the compartment 68 is less than the difference between the fluid pressures acting against the left-hand side of the piston 48 and the right-hand side of the land 36. The bias of the spring 140 in compartment 74 (when compared with the difference between the fluid pressures acting against the right-hand side of piston 46 and left-hand side of land 34) is selected in a similar manner. The compartment 68 communicates with the return port 22 via channel 126 and space 124. The check valve 134 is closed because the pressure of fluid in portion 91 of the channel 90 is substantially less than the fluid pressure in the chamber 70. The pressure at both sides of the check valve 136 is the same; therefore, the valve member of the valve (e.g., a customary ball check valve) is held in closed position by the valve spring.

FIG. 6 shows an intermediate stage of movement of the center land 26 from the right-hand end position of FIG. 5 to the left-hand end postion. Such movement of the center land 26 is initiated by short-lasting energization of the winding 56 in the pilot valve 84. The left-hand armature 54 then seals the corresponding seat 83 and allows the channel 88 to communicate with the left-hand return port 60. Thus, the pressure of fluid in the chamber 66 decreases. Consequently, pressurized fluid in the space 122 is free to move the outer land 36 away from the seat 40; such movement of the land 36 is promoted by the spring 138 in the compartment 68. The space 122 is then free to communicate with the return port 24 and the pressure of fluid therein decreases. The drop of fluid pressure in space 122 is communicated to the compartment 74 via channel 128. The pressure of fluid in the compartment 74 decreases on the additional ground that the check valve 136 in the channel 88 opens as soon as the pressure of fluid in the chamber 66 decreases. Once the pressure of fluid in the compartment 74 decreases to or close to atmospheric pressure, the piston 46 (which is acted upon by pressurized fluid in chamber 70) moves the outer land 34, shank 14 and center land 26 in a direction to the left. The land 34 engages the seat 38 to seal the space 124 from the return port 22. The shank 14 has moved the left-hand sealing ring of the center land 26 into immediate proximity of the seat 32 so that the sapce 124 receives pressurized fluid from the pressure port 16. The movement of land 34 in response to fluid pressure in the chamber 70 terminates before the center land 26 can reach the seat 32 because the land 34 is intercepted by the respective seat 38. The last stage of movement of center land 26 into sealing engagement with the seat 32 is effected by forces furnished by pressurized fluid which establishes a pressure differential at the opposite sides of the land 26. Thus, the pressure at the left-hand side of the center land 26 equals or is less than atmospheric pressure while the pressure in space 124 matches the pressure of fluid in the port 16.

The end portions of the shank 14 extend, with some freedom of axial movement, into the recesses 110 of both outer lands 34, 36. This completes the movement of center land 26 to the left-hand end position. The winding 56 of the pilot valve 84 can be deenergized so that the left-hand armature 54 moves back into sealing engagement with the respective return port 60 and allows the left-hand seat 83 to connect the channel 86 with the channel 88. Thus, the pressure of fluid in the chamber 66 again matches the pressure in the port 16. However, the compartment 68 is also filled with pressurized fluid which is supplied by space 124 via channel 126; therefore, the pressure of fluid acting against the left-hand side of the piston 46 is balanced by pressure in the compartment 68 plus the bias of the spring 138. Consequently, the piston 46 cannot move the center land 26 away from the seat 32.

The compartment 74 does not contain pressurized fluid because it communicates with the space 122 (which is connected to the return port 24) by way of the channel 128. Pressurized fluid which fills the chamber 66 cannot flow into the compartment 74 because the right-hand portion 89 of the channel 88 is sealed from the chamber 66 by check valve 136.

If the center land 26 is to return to the end position of FIG. 5, the winding 56 of the pilot valve 82 is energized for a short interval of time whereby the pressure in chamber 70 and compartment 68 decreases and the piston 48 causes the lands 26, 34, 36 to reassume the positions shown in FIG. 5 for reasons analogous to those pointed out above in connection with short-lasting opening of pilot valve 84. This is due to mirror-symmetrical construction of the valve 10''' with respect to a plane normal to the shank 14 and halving the space 28.

The flow restrictor 132 performs the following function: when the winding 56 of the pilot valve 84 is energized to effect a movement of center land 26 from the end position of FIG. 5 toward the other end position, the pressure of fluid in the channel 88 decreases. However, the pressure of fluid in the compartment 74 still matches the pressure of fluid in the port 16 because the compartment 74 communicates with the space 122 via channel 128. Therefore, the check valve 136 opens to effect a reduction of fluid pressure in the compartment 74. The restrictor 132 prevents the flow of pressurized fluid from space 122 (wherein the pressure of fluid still matches the pressure of fluid in the port 16) into the compartment 74 at a relatively high rate which would delay the drop of pressure in this compartment. The flow restrictor 130 performs a similar function when the pilot valve 82 is actuated to effect a movement of the center land 26 back to the end position of FIG. 5.

Each of the pistons 46, 48 shown in FIGS. 5 and 6 comprises an elastic membrane 120 having a preferably beaded peripheral portion which is anchored in and sealingly secured to the adjacent internal surface of the valve body 12. The central portion of each membrane 120 is affixed to the respective shaft (42, 44) by washers and screws or in another suitable way. An advantage of such elastically deformable pistons is that they meet the most stringent requirements of environments, i.e., the fluid which is being used in the valve body 12 cannot escape and the pistons require no lubrication with oil or the like.

Without further analysis, the foregoing will so fully reveal the gist of the present invention that others can, by applying current knowledged, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

1. In a pilot-operated directional control valve, a combination comprising a hollow valve body having a pressure port, an internal space communicating with said pressure port, spaced-apart first and second seats in said space, first and second working ports flanking said pressure port and respectively communicating with said first and second seats, and first and second return ports respectively adjacent to said first and second working ports; a spool reciprocable in said body and including an elongated shank having first and second end portions, a center land rigid with said shank and disposed in said space between said seats, and first and second outer lands respectively disposed intermediate and having permanent freedom of movement between said first working port and said first return port and between said second working port and said second return port, said first and second outer lands respectively having first and second recesses reciprocally receiving said first and second end portions of said shank; and first and second pistons mounted in said body and respectively cooperating with said first and second outer lands, said pistons being movable in said body so that lengthwise movement of said shank and said lands is effected, and said